US005649884A

United States Patent [19]

Manalo

[11] Patent Number: 5,649,884

[45] Date of Patent: Jul. 22, 1997

[54] CHIROPRACTIC DEVICE FOR CONCURRENTLY MASSAGING AND EXERCISING A USER

[76] Inventor: Manuel P. Manalo, P.O. Box 5237, North Hollywood, Calif. 91616-5237

[21] Appl. No.: 549,966

[22] Filed: Oct. 30, 1995

[51] Int. Cl.[6] ..... A63B 21/002; A61H 7/00

[52] U.S. Cl. ..... 482/91; 482/41; 482/92; 482/148; 601/135; 601/137; 138/115

[58] Field of Search ..... 482/16, 34, 38, 482/41, 91, 92, 106, 108, 110, 139, 148; 601/122, 123, 125, 134, 135, 137; 434/234; 138/115, 117

[56] References Cited

U.S. PATENT DOCUMENTS

| | | | |
|---|---|---|---|
| 3,083,964 | 4/1963 | Wentzel | 482/34 |
| 3,258,790 | 7/1966 | Maru | 482/10 |
| 3,625,258 | 12/1971 | Phelps | 138/115 |
| 3,820,781 | 6/1974 | Kane | 482/110 |
| 4,114,612 | 9/1978 | Benjamin | 482/10 |
| 4,406,450 | 9/1983 | Regan | 482/41 |
| 4,854,573 | 8/1989 | Johannson et al. | 482/41 |
| 5,236,016 | 8/1993 | Vogelsang | 138/115 |
| 5,524,813 | 6/1996 | Pease | 228/212 |

FOREIGN PATENT DOCUMENTS

| | | | |
|---|---|---|---|
| 1039932 | 10/1953 | France | 601/122 |
| 748 | 1/1884 | United Kingdom | 138/117 |
| 1878 | 2/1892 | United Kingdom | 138/115 |

*Primary Examiner*—Richard J. Apley
*Assistant Examiner*—Victor K Hwang

[57] ABSTRACT

A chiropractic device for concurrently massaging and exercising a user comprising elongated hollow cylindrical tubes fabricated of a rigid metallic material. Each tube has a length with an external diameter and an internal diameter with an aperture through each tube. A plurality of welds are provided. Each weld is of a linear extent corresponding to the length of the tubes. The welds couple to and secure together the three tubes along their contacting lengths to form a cluster of tubes in a triangular configuration with each tube coupled to the other two tubes along their entire contacting lengths.

4 Claims, 3 Drawing Sheets

CHIROPRACTIC DEVICE FOR CONCURRENTLY MASSAGING AND EXERCISING A USER

BACKGROUND OF THE INVENTION

1. Field of the Invention

The present invention relates to a chiropractic device for concurrently massaging and exercising a user and more particularly pertains to massaging a user while exercising through a rigid elongated cluster of coupled tubes.

2. Description of the Prior Art

The use of exercising devices and massaging devices of various designs and configurations is known in the prior art. More specifically, exercising devices and massaging devices of various designs and configurations heretofore devised and utilized for the purpose of massaging and exercising through the aid of various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 4,807,603 to Yasui a massaging device having cylindrical body with at least one groove.

U.S. Pat. No. 4,519,605 to Leland discloses a combination exercise and massage apparatus.

U.S. Pat. No. 5,020,518 to Spears et al., discloses a travelling roller massage apparatus.

U.S. Pat. No. 4,378,007 to Kachadourian discloses a massaging device.

Lastly, U.S. Pat. No. 5,170,778 to Jamis discloses a body massaging device.

In this respect, the chiropractic device for concurrently massaging and exercising a user according to the present invention substantially departs from the conventional concepts and designs of the prior art, and in so doing provides an apparatus primarily developed for the purpose of massaging a user while exercising through a rigid elongated cluster of coupled tubes.

Therefore, it can be appreciated that there exists a continuing need for new and improved chiropractic device for concurrently massaging and exercising a user which can be used for massaging a user while exercising through a rigid elongated cluster of coupled tubes. In this regard, the present invention substantially fulfills this need.

SUMMARY OF THE INVENTION

In view of the foregoing disadvantages inherent in the known types of exercising devices and massaging devices of various designs and configurations now present in the prior art, the present invention provides an improved chiropractic device for concurrently massaging and exercising a user. As such, the general purpose of the present invention, which will be described subsequently in greater detail, is to provide a new and improved chiropractic device for concurrently massaging and exercising a user apparatus and method which has all the advantages of the prior art and none of the disadvantages.

To attain this, the present invention essentially comprises a new and improved chiropractic device for concurrently massaging and exercising a user, comprising, in combination, three elongated hollow cylindrical tubes fabricated of a rigid metallic material. Each tube is about 47 inches long with an external diameter of about 0.50 inches and an internal diameter of about 0.35 inch. A plurality of welds are provided. Each weld is of a linear extent corresponding to the length of the tubes. The weld couple to and secure together the three tubes along their contacting lengths to form a cluster of tubes in a triangular configuration with each tube coupled to the other two tubes along their entire contacting lengths. A pair of triangular end caps are provided. One end cap is at each end of the coupled cluster of tubes. The triangles are essentially equilateral triangles with 60 degree angles with each end cap coupled to an associated end of the cluster of tubes. The end caps have apexes overlying the aperture of one tube.

It is therefore an object of the present invention to provide a new and improved chiropractic device for concurrently massaging and exercising a user which has all the advantages of the prior art exercising devices and massaging devices of various designs and configurations and none of the disadvantages.

It is another object of the present invention to provide a new and improved chiropractic device for concurrently massaging and exercising a user which may be easily and efficiently manufactured and marketed.

It is a further object of the present invention to provide a new and improved chiropractic device for concurrently massaging and exercising a user which is of a durable and reliable construction.

An even further object of the present invention is to provide a new and improved chiropractic device for concurrently massaging and exercising a user which is susceptible of a low cost of manufacture with regard to both materials and labor, and which accordingly is then susceptible of low prices of sale to the consuming public, thereby making such exercising devices and massaging devices of various designs and configurations economically available to the buying public.

Still yet another object of the present invention is to provide a new and improved chiropractic device for concurrently massaging and exercising a user which provides in the apparatuses and methods of the prior art some of the advantages thereof, while simultaneously overcoming some of the disadvantages normally associated therewith.

Still another object of the present invention is to massage a user while exercising through a rigid elongated cluster of coupled tubes.

Lastly, it is an object of the present invention to provide a new and improved chiropractic device for concurrently massaging and exercising a user comprising elongated hollow cylindrical tubes fabricated of a rigid metallic material. Each tube has a length with an external diameter and an internal diameter with an aperture through each tube. A plurality of weld are provided. Each weld is of a linear extent corresponding to the length of the tubes. The weld couple to and secure together the three tubes along their contacting lengths to form a cluster of tubes in a triangular configuration with each tube coupled to the other two tubes along their entire contacting lengths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
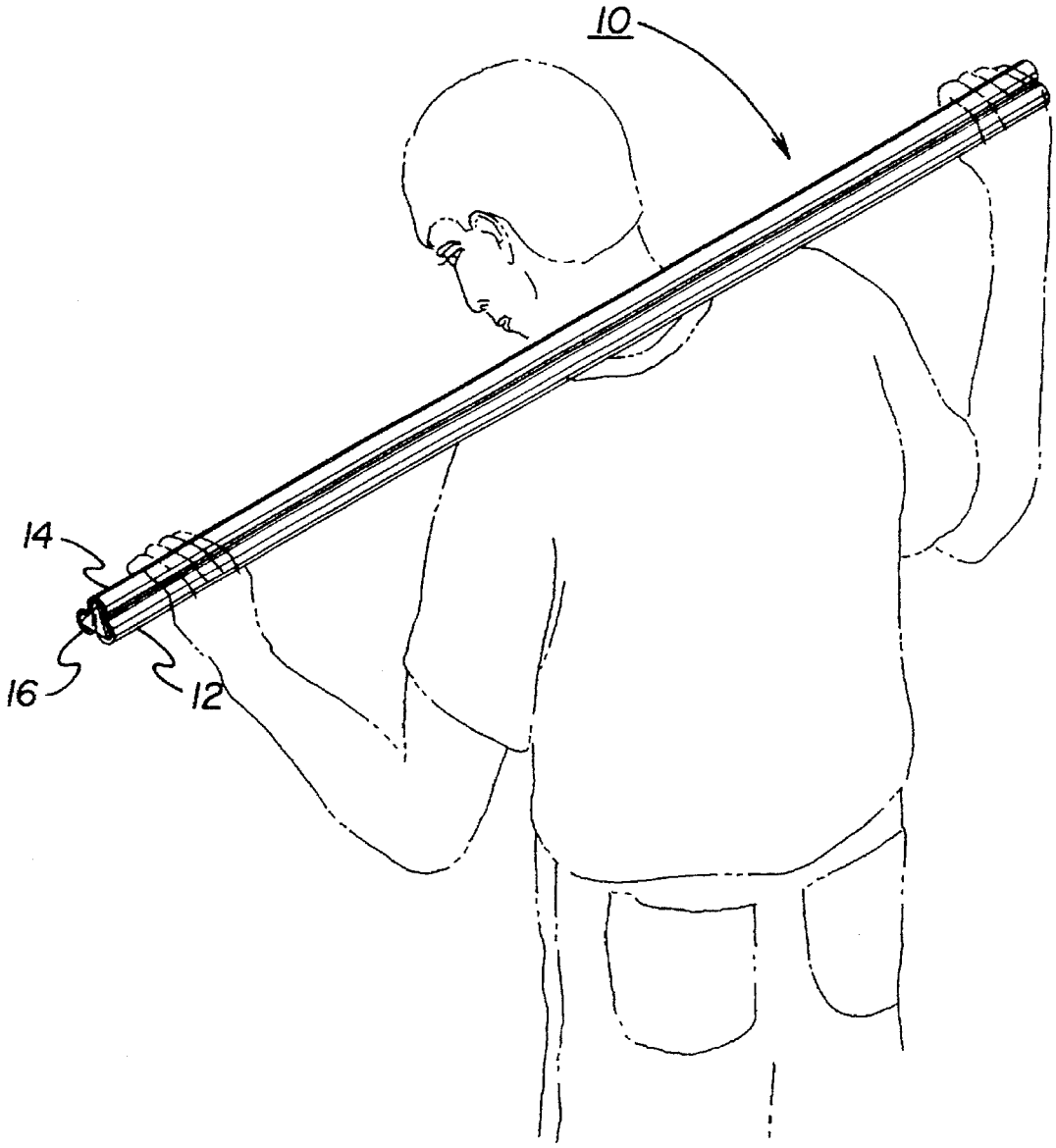
FIG. 1 is a perspective illustration of the preferred embodiment of the chiropractic device for concurrently massaging and exercising a user constructed in accordance with the principles of the present invention.
Figure 2:
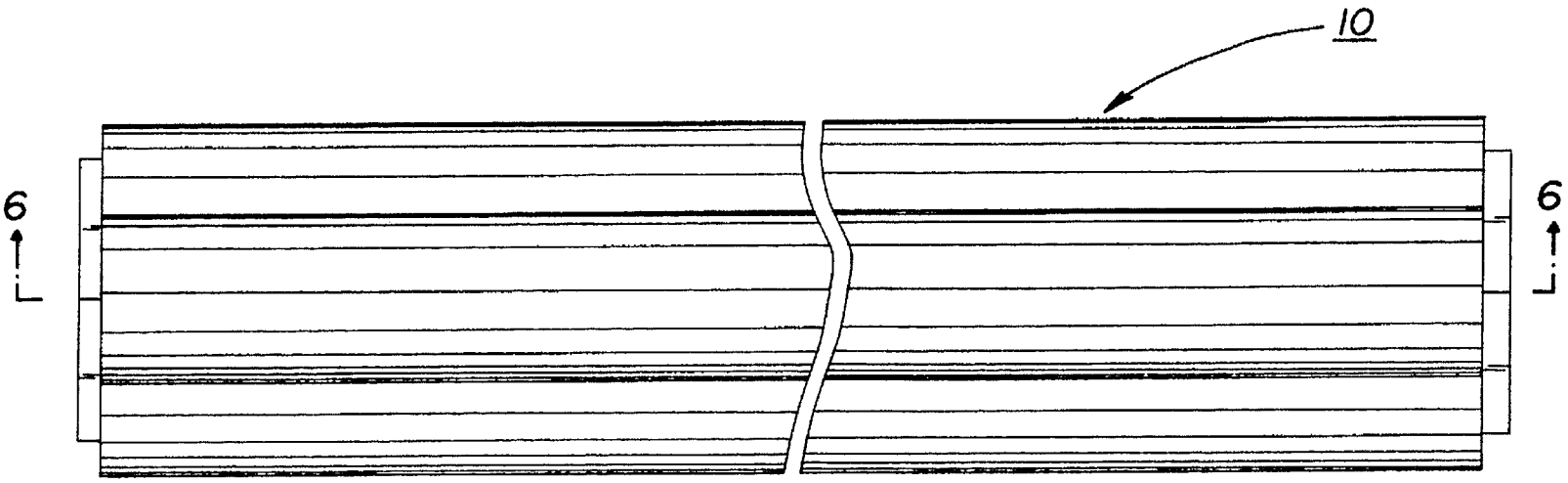
FIG. 2 is a top elevational view of the device shown in FIG. 1.
Figure 3:
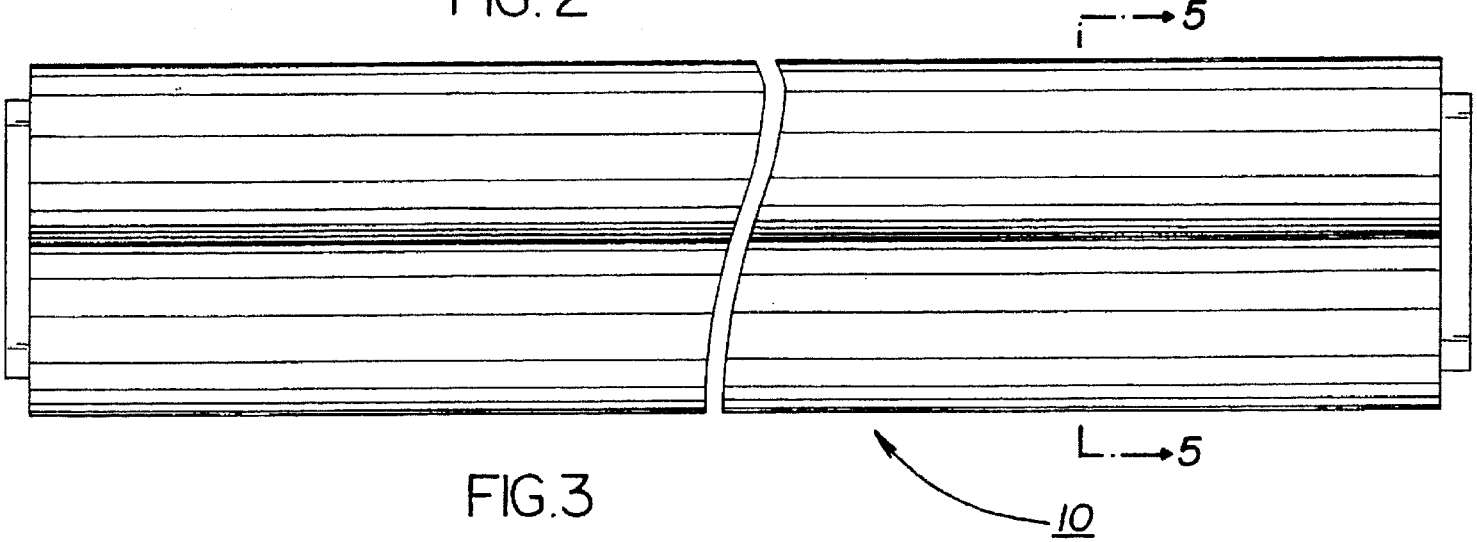
FIG. 3 is a side elevational view of the device shown in FIGS. 1 and 2.
Figure 5:
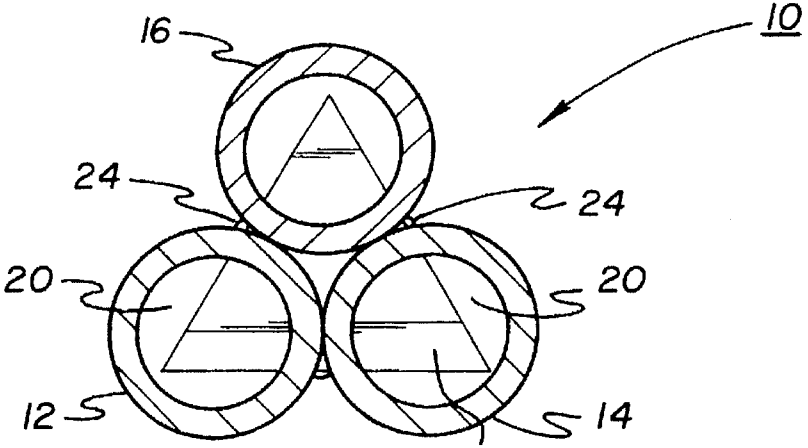
FIG. 5 is a cross sectional view taken along line 5—5 of FIG. 3.
Figure 4:
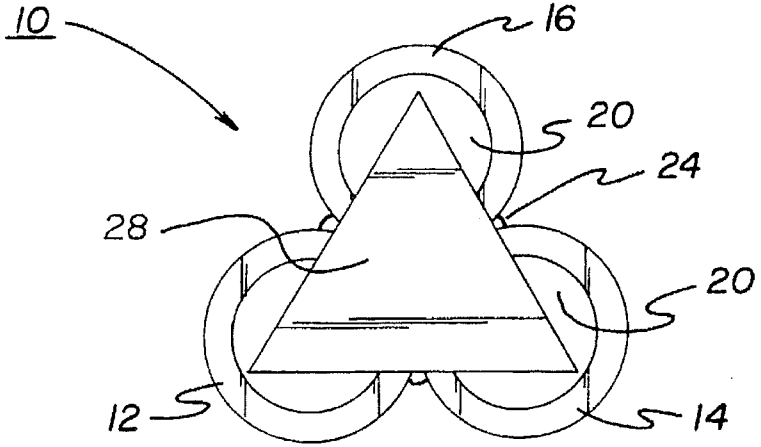
FIG. 4 is an end view of the device shown in the prior Figures.
Figure 6:
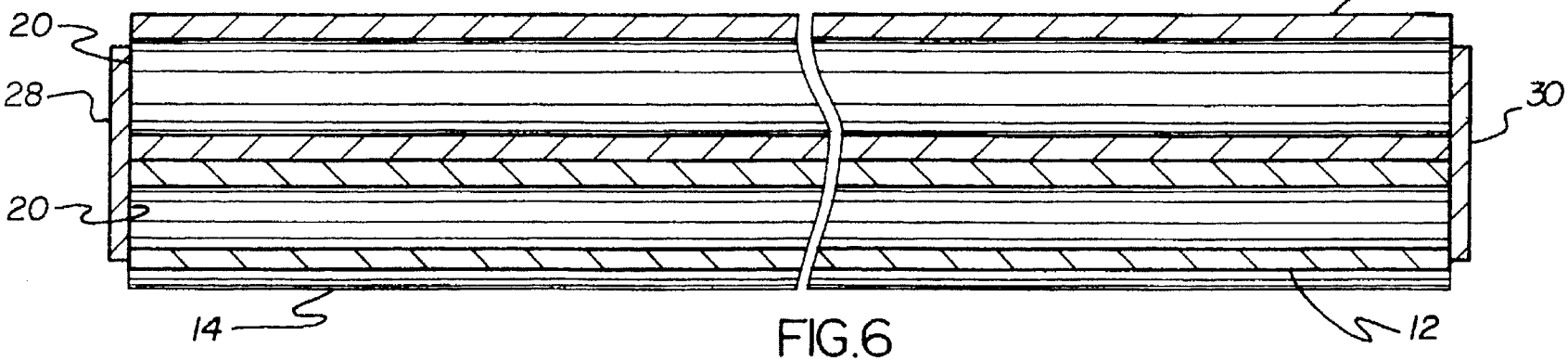
FIG. 6 is a cross sectional view taken along line 6—6 of FIG. 2.

With reference now to the drawings, and in particular to FIG. 1 thereof, a new and improved chiropractic device for concurrently massaging and exercising a user embodying the principles and concepts of the present invention and generally designated by the reference numeral 10 will be described.

The present invention, the new and improved chiropractic device for concurrently massaging and exercising a user, is comprised of a plurality of components. Such components in their broadest context include three elongated hollow cylindrical tubes, a plurality of welds and a pair of triangular end caps. Such components are individually configured and correlated with respect to each other so as to attain the desired objective.

More specifically, the present invention is in effect a system 10 which has as its central components three elongated hollow cylindrical tubes 12, 14, 16. Such tubes are preferably fabricated of a rigid metallic material. Appropriate materials included rigid metals selected from the class of rigid metals, including plated steel, stainless steel and aluminum. Other appropriate materials of similar structural characteristics could readily be utilized.

Each tube is about 47 inches in length. Each tube has an external diameter of about 0.50 inches. The internal diameter of each tube is about 0.35 inches. The tubes are cylindrical with an aperture 20 extending through each tube along the entire length thereof.

The next component of the system are a plurality of weld 24. Each weld is of a linear extent. The linear extent corresponds to the length of the tubes. The welds are coupled to the tubes for securing together three tubes along their contacting length. The contacting and welded tubes thus form a cluster of tubes in a triangular configuration. Each tube is coupled to the other two tubes along their entire contacting lengths.

Lastly provided are a pair of triangular end caps 28, 30. One end cap is located at each end of the coupled cluster of tubes. The triangles are essentially equal lateral triangles. They are formed with 60 degree angles at their apexes. Each end cap is coupled to an associated end of the cluster of tubes. The end caps have apexes. Each apex overlies an aperture of one tube.

A device with which to relax fatigued body parts by massaging or exercising them with it. It is made from plated or stainless steel, or aluminum, and consists of three strong tubes. Each tube is 47 inches long and ½ inch in diameter. They are welded together tangentially to form a triangular shaped cluster. Their ends are flush with each other. The resultant device is strong enough to withstand bending while being used. Optionally, only two tubes could be used if strong enough. All surfaces are smooth and all edges are rounded to prevent injury to the users.

To relax a tired neck or aching back due to spinal column fatigue, hold it across the spinal column and rub it up and down on the back. Place it across the shoulders with the arms resting on each end, and twist the body right to left and left to right, to relax shoulder and neck muscles. Also, with the device being held in the same position, bend the trunk forward, to the right and left, to benefit the waist. Grip it with the hands and twist the wrist back and forth, to release tension in the arm, wrist and shoulder.

It provides a means for relaxing a person's neck, shoulder, back, arms, wrists, and other fatigued and stiff body parts. Additional massage and exercise routines could be developed with this device.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A chiropractic device for concurrently massaging and exercising a user comprising:

three elongated hollow cylindrical tubes fabricated of a rigid metallic material, each tube having a length with an external diameter and an internal diameter with an aperture through each tube; and a plurality of welds, the welds coupled to and securing together the three tubes along their contacting lengths to form a cluster of tubes in a triangular configuration with each tube coupled to the other two tubes along their contacting lengths, each tube being in linear contact with the other two tubes along their entire lengths.

2. The device as set forth in claim 1 and further including a pair of triangular end caps, one end cap at each end of the coupled cluster of tubes, the the triangular end caps being essentially equilateral triangles with 60 degree angles with each end cap coupled to an associated end of the cluster of tubes, the end caps having apexes overlying the aperture of one tube.

3. The device as set forth in claim 1 wherein the tubes are fabricated of a rigid metallic material selected from the group of rigid metallic materials consisting of plated steel, stainless steel and aluminum.

4. A new and improved chiropractic device for concurrently massaging and exercising a user, comprising, in combination:

three elongated hollow cylindrical tubes fabricated of a rigid metallic material, each tube being about 47 inches long with an external diameter of about 0.50 inches and an internal diameter of about 0.35 inch;

a plurality of welds, each weld being of a linear extent corresponding to the length of the tubes, the welds coupled to and securing together the three tubes along their contacting lengths to form a cluster of tubes in a triangular configuration with each tube coupled to the other two tubes along their entire contacting lengths; and a pair of triangular end caps, one end cap at each end of the coupled cluster of tubes, the triangles being essentially equilateral triangles with 60 degree angles with each end cap coupled to an associated end of the cluster of tubes, the end caps having apexes overlying the aperture of one tube.

* * * * *